US006547619B1

(12) United States Patent
Ohkawai et al.

(10) Patent No.: US 6,547,619 B1
(45) Date of Patent: Apr. 15, 2003

(54) ARC TUBE FOR DISCHARGE LAMP UNIT AND METHOD OF MANUFACTURING SAME

(75) Inventors: Nobuo Ohkawai, Shizuoka (JP); Yoshitaka Ohshima, Shizuoka (JP); Shinichi Irisawa, Shizuoka (JP); Masakazu Nagasawa, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 258 days.

(21) Appl. No.: 09/599,721

(22) Filed: Jun. 23, 2000

(30) Foreign Application Priority Data

Jun. 25, 1999 (JP) ..... 11-180648

(51) Int. Cl.[7] ..... H01J 9/28
(52) U.S. Cl. ..... 445/26; 445/43; 445/39
(58) Field of Search ..... 445/26, 3, 39, 445/43

(56) References Cited

U.S. PATENT DOCUMENTS

| | | | | |
|---|---|---|---|---|
| 5,286,227 A | | 2/1994 | Numajiri et al. | 445/26 |
| 5,936,349 A | | 8/1999 | Fukai et al. | 303/623 |
| 5,986,403 A | * | 11/1999 | Jansen et al. | 445/26 |
| 6,354,900 B1 | * | 3/2002 | Ohshima et al. | 445/26 |

FOREIGN PATENT DOCUMENTS

| | | | | |
|---|---|---|---|---|
| GB | 2 274 350 A | | 7/1994 | H01J/61/36 |
| GB | 2 338 823 A | | 12/1999 | H01J/61/36 |
| WO | WO 96/34405 A2 | * | 10/1996 | |

* cited by examiner

*Primary Examiner*—Kenneth J. Ramsey
(74) *Attorney, Agent, or Firm*—Sughrue Mion, PLLC

(57) ABSTRACT

A method of manufacturing an arc tube for a discharge lamp unit, incorporating a primary pinch-sealing step for mounting an electrode assembly in an open end of a glass tube W with a chamber portion 12. The electrode assembly comprises an electrode rod 6, a connecting foil 7 and a lead wire 8 integrally connected in series. The electrode assembly is inserted into an open end of the glass tube W such that a leading end of the electrode rod projects into the chamber portion 12. A temporary pinch seal region $L_1$ of the glass tube W is pinch-sealed such that a portion of the connecting foil that is connected to the lead wire is contacted by the glass tube W. A vacuum is maintained inside the glass tube and a main pinch seal region $L_2$ of the glass tube is pinch-sealed such that a portion of the connecting foil connected to the electrode rod is contacted by the glass tube. When the main pinch seal region $L_2$ of glass tube W is pinch-sealed, the negative pressure in the glass tube W is exerted on the softened sealed chamber portion 12 owing to supplied heat as well as the pressure exerted from the pincher 26*b*. Thus, the glass layer 15 is pressed against the surface of the molybdenum foil 7 so that hermetic contact is realized.

14 Claims, 4 Drawing Sheets

W
W1
W2
W3
A
A'
P
Xe
LN2
22
24
24a
24b
26a
26b
26c
40
42
44
50
52
54
6
7
8
8b

ARC TUBE FOR DISCHARGE LAMP UNIT AND METHOD OF MANUFACTURING SAME

BACKGROUND OF THE INVENTION

1. Technical Field of the Invention

The present invention relates to an arc tube for a discharge lamp unit structured such that two electrode assemblies are disposed opposite to each other in a central sealed chamber. Each electrode assembly includes an electrode rod, molybdenum foil and a lead wire. One electrode is sealed in a primary pinch seal portion and a second electrode is sealed in a secondary pinch seal portion. The central sealed chamber encloses light emitting substances. The present invention also relates to a method of manufacturing the arc tube.

2. Prior Art

FIG. 5 shows a conventional discharge lamp unit which incorporates an arc tube 5 having a front end supported by one lead support 2 projecting forward from an insulating base 1. A recess 1*a* of the base 1 supports the rear end of the arc tube 5. A metal support member S, secured to front surface of the insulating base 1 holds a portion of the arc tube adjacent to the rear end of the arc tube. A front lead wire 8, extending from the arc tube 5, is welded to the lead support 2, while a rear lead wire 8 penetrates a bottom wall 1*b* having the recess 1*a* of the base 1 formed therein. Then, the rear lead wire 8 is securely welded to a terminal 3 provided in the bottom wall 1*b*. Symbol G represents an ultraviolet-ray shielding globe arranged to remove an ultraviolet-ray component in the wavelength region harmful to the human body. The ultraviolet-ray shielding globe forms a cylindrical shape and is integrally welded to the arc tube 5.

The arc tube 5 has a sealed chamber portion 5*a* formed between a pair of front and rear pinch seal portions 5*b*. The sealed chamber portion 5*a* has electrode rods 6 disposed opposite to each other and contains light emitting substances. In the pinch seal portions 5*b*, the sealed molybdenum foil 7 connects the electrode rod 6 projecting into the sealed chamber portion 5*a* to the lead wire 8 extending from the pinch seal portion 5*b* to each other. Thus, the pinch seal portions 5*b* remain airtight.

Preferably, the electrode rod 6 is made of tungsten exhibiting excellent durability. Tungsten has a coefficient of linear expansion that is considerably different from that of quartz glass that constitutes the arc tube. Worse, only unsatisfactory conformability with quartz glass is permitted and the permitted airtightness is unsatisfactory. Therefore, the molybdenum foil 7 having a coefficient of linear expansion similar to that of quartz glass and exhibiting relatively satisfactory conformability is connected to the tungsten electrode rods 6. The pinch seal portion 5*b* seals the molybdenum foil 7. Thus, the pinch seal portion 5*b* remains airtight.

A method of manufacturing the arc tube 5 is arranged as shown in FIG. 6(*a*). An electrode assembly A comprises the electrode rod 6, the molybdenum foil 7 and the lead wire 8. The components are integrally connected. The electrode assembly A is initially inserted into an end of either opening of a cylindrical glass tube W having a spherical expanded portion $w_2$ disposed at an intermediate position of a straight extending portion $w_1$. Then, adjacent position $q_1$ of the spherical expanded portion $w_2$ is first pinch-sealed.

Referring to FIG. 6(*b*), a light emitting substance P is introduced into the spherical expanded portion $w_2$ through the other end opening of cylindrical glass tube W.

Referring to FIG. 6(*c*), a second electrode assembly A is inserted. A second pinch sealing operation seals the spherical expanded portion $w_2$, while simultaneously cooling the spherical expanded portion $w_2$ by using liquid nitrogen to prevent both vaporization of the light emitting substance P and heating the adjacent position $q_2$ of the spherical expanded portion $w_2$. The final result is an arc tube 5 having the chipless sealed chamber portion 5*a*. The first pinch-sealing step shown in FIG. 6(*b*) uses inactive gas (in general, which is low-cost argon gas or nitrogen gas) as forming gas into the glass tube W in order to prevent oxidation of the electrode assembly A. In the second pinch-sealing step shown in FIG. 6(*c*), the ends of the openings in cylindrical glass tube W are closed and cooling with liquid nitrogen prevents vaporization of the light emitting substance P. Therefore, a state of near vacuum is necessary for the pinch-sealing operation.

Since a great temperature change occurs when the arc tube is energized, thermal stress is produced between the molybdenum foil 7 and the glass layer. The molybdenum foil 7 and the glass layer each have considerably different coefficients of linear expansion. Recent developments in arc tubes allow instantaneous lighting. Therefore, a high temperature-rise ratio is realized, which rapidly produces thermal stress. Although the molybdenum foil has a relatively satisfactory conformability with glass, repeated cycling of the arc tube causes a gap to be formed between the molybdenum foil 7 and the glass layer in the primary pinch seal portion. Thus, the sealed light emitting substance P leaks into the foregoing gap, thereby changing the characteristics of the arc tube. Thus, a lighting defect occurs and the life of the arc tube is shortened.

BRIEF SUMMARY OF THE INVENTION

In view of the foregoing, an object of the present invention is to provide a method of manufacturing an arc tube for a discharge lamp unit with which satisfactory conformability is realized between molybdenum foil and a glass layer in a primary pinch seal portion and improving the adhesion of the glass layer to the molybdenum foil and an arc tube.

To achieve the foregoing object, according to one aspect of the invention, there is provided a method of manufacturing an arc tube for a discharge lamp unit, comprising a primary pinch-sealing step for mounting an electrode assembly in an open end of a glass tube, the glass tube including a chamber portion, and the electrode assembly comprising an electrode rod, a connecting foil and a lead wire integrally connected in series, the primary pinch-sealing step further comprising inserting the electrode assembly into the open end of the glass tube such that a leading end of the electrode rod projects into the chamber portion, pinch-sealing a first region of the primary pinch seal portion of the glass tube such that a portion of the connecting foil that is connected to the lead wire is contacted by the glass tube, and maintaining a vacuum inside the glass tube under vacuum and pinch-sealing a second region of the primary pinch seal portion of the glass tube such that a portion of the connecting foil and the electrode rod are contacted by the glass tube.

According to another aspect of the invention, there is provided a method of manufacturing an arc tube for a discharge lamp unit, further comprising supplying a substance to the inside portion of the glass through an open end of a glass tube, and a secondary pinch-sealing step for mounting an electrode assembly in the open end of a glass tube, the electrode assembly comprising an electrode rod, a connecting foil and a lead wire integrally connected in series, the secondary pinch-sealing step further comprising inserting the electrode assembly into the open end of the glass tube such that a leading end of the electrode rod projects into the chamber portion, supplying an inactive gas to the inner portion of the glass tube, pinch-sealing a region of the glass tube such that a portion of the lead wire is contacted by the glass tube, cooling the inactive gas in order to liquefy the inactive gas, thereby producing a vacuum in the glass tube, and pinch-sealing a secondary pinch seal portion of the glass tube such that the electrode rod, the connecting foil and the lead wire are contacted by the glass tube.

According to another aspect of the invention, there is provided an arc tube for a discharge lamp unit comprising a glass tube having a sealed chamber disposed at a lengthwise-directional intermediate portion of the glass tube in which a light emitting substance is sealed, the glass tube having a primary pinch seal portion disposed adjacently to the sealed chamber and a secondary pinch seal portion disposed adjacently to the sealed chamber and on an opposite side from the primary pinch seal portion, a pair of electrode assemblies, each comprising an electrode rod, molybdenum foil and a lead wire integrally connected in series, wherein one of the electrode assemblies is enclosed in the primary pinch seal portion such that the lead wire projects from the primary pinch seal portion, wherein the primary pinch seal portion is formed by inserting the electrode assembly into an open end the glass tube such that a leading end of the electrode rod projects into the sealed chamber, pinch-sealing a first region of the glass tube such that a portion of the molybdenum foil that connects the lead wire is contacted by the glass tube, evacuating an inside portion of the glass tube and pinch-sealing the remainder of the glass tube between the first region and the sealed chamber.

According to another aspect of the invention, there is provided an arc tube for a discharge lamp unit, wherein the secondary pinch seal portion encloses one of the pair of electrode assemblies such that the lead wire projects from the secondary pinch seal portion, the secondary pinch seal portion is formed by inserting the electrode assembly into the open end of the glass tube such that a leading end of the electrode rod projects into the sealed chamber, introducing an inactive gas into the sealed chamber, pinch-sealing a portion of the glass tube such that it only contacts the lead wire, cooling and liquefying the inactive gas in order to produce a vacuum in the glass tube and pinch-sealing the secondary pinch seal portion such that the electrode rod, the connecting foil and the lead wire are all contacted by the glass tube.

When a pinch-sealing operation is performed, the pressure exerted by a pincher and the negative pressure in the glass tube act on the glass layer, which is softened due to applied heat. Thus, the glass layer is pressed against the surface of the molybdenum foil so that adhesion without any gap is realized. The portion which has been pinch-sealed during the pinch-sealing step causes satisfactory conformability to be realized between the molybdenum foil and the glass layer. The two elements are firmly joined to each other. Unlike conventional technology, no gap is formed between the glass layer and the molybdenum foil that allows the undesirable leaking of the sealed substance from the chamber portion.

According to another aspect of the invention, there is provided a method of manufacturing an arc tube for a discharge lamp unit wherein the length of the main pinch seal region $L_2$ is not lower than about 50% of the overall length of the temporary pinch seal region $L_1$, and a portion of the main pinch seal region overlaps the temporary pinch seal region.

As the main pinch seal region of the primary pinch seal portion is elongated, the adhesion between the glass layer and the molybdenum foil can be improved. Moreover, the bonding strength between the two elements is increased. Therefore, it is preferable that the main pinch seal region is elongated. Formation of a gap between the glass layer and the molybdenum foil caused from thermal stress must be prevented. Therefore, it is preferable that the length of the main pinch seal region is 50% or longer the overall length of the primary pinch seal portion to make the portion longer than about half of the overall length of the molybdenum foil to be pinch-sealed.

Since the main pinch seal portion overlaps the temporary pinch seal portion in the axial direction, the overall region to be pinch-sealed can reliably be pinch-sealed.

According to another aspect of the invention, wherein a pressure of 400 Torr or lower is maintained in the inside portion of the glass tube when a pinch-sealing step is performed.

When the pressure in the glass tube is not lower than the 400 Torr, the conformability between the glass layer and the molybdenum foil becomes insufficient and a firm joint cannot be realized. When the pressure is 400 Torr or lower, satisfactory conformability can be realized between the glass layer and the molybdenum foil. As a result, firm joint can be realized.

BRIEF DESCRIPTION OF THE DRAWINGS

FIG. 3(*b*) is an enlarged cross sectional view showing the primary pinch seal portion which has a temporary pinch seal region pinch-sealed;

FIG. 3(*c*) is an enlarged cross sectional view showing the primary pinch seal portion which has a main pinch seal region pinch-sealed;

FIG. 4(*b*) is a diagram showing a main pinch-sealing step in the primary pinch-sealing step;

FIG. 4(*c*) is a diagram showing a step for introducing light emitting substances and a second electrode assembly;

FIG. 4(*d*) is a diagram showing a chip-off step;

FIG. 4(*e*) is a diagram showing a secondary pinch-sealing step;

DETAILED DESCRIPTION OF THE INVENTION

Figure 1:
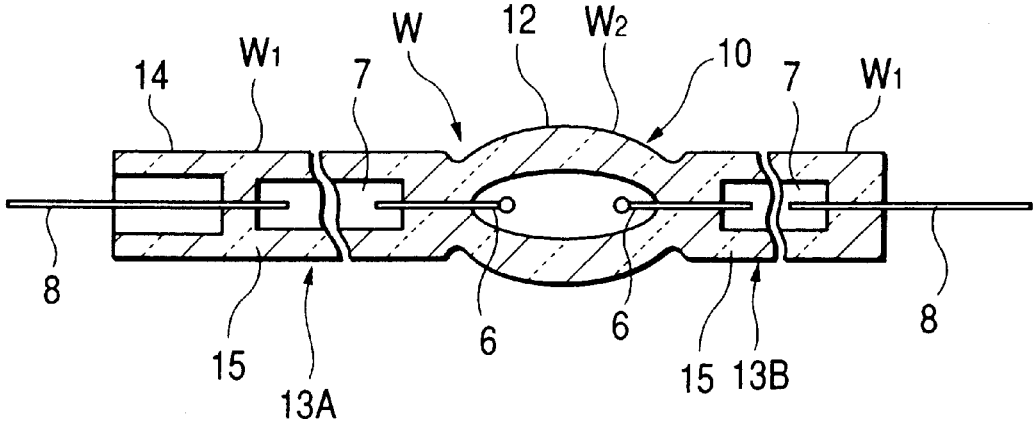
FIG. 1 is a vertical cross sectional view showing an arc tube for a discharge lamp unit according to an embodiment of the present invention.

Referring now to the drawings, a preferred embodiment will be described.

Figure 2:
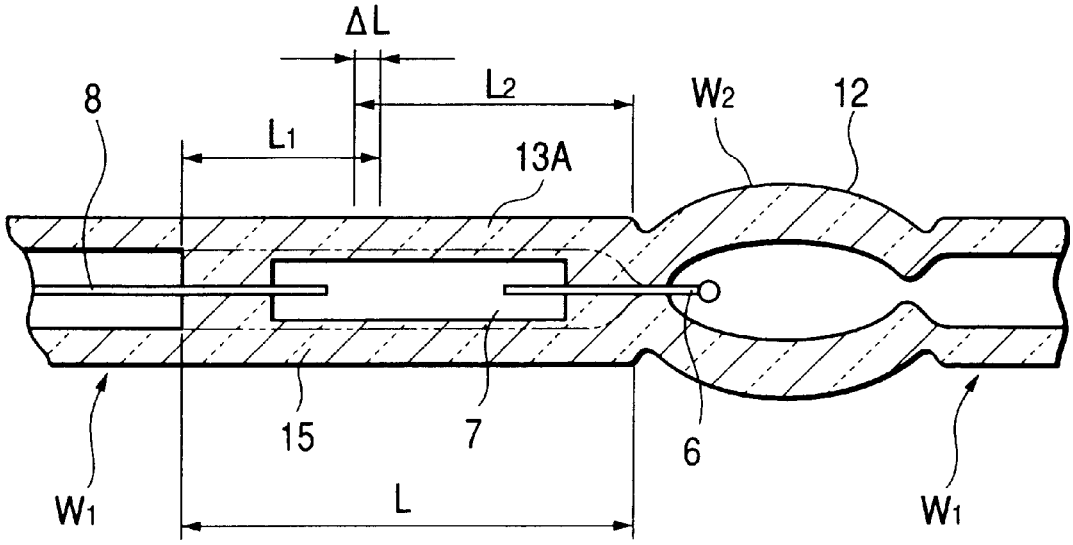
FIG. 2 is an enlarged cross sectional view showing a primary pinch seal portion.
Figure 3A:
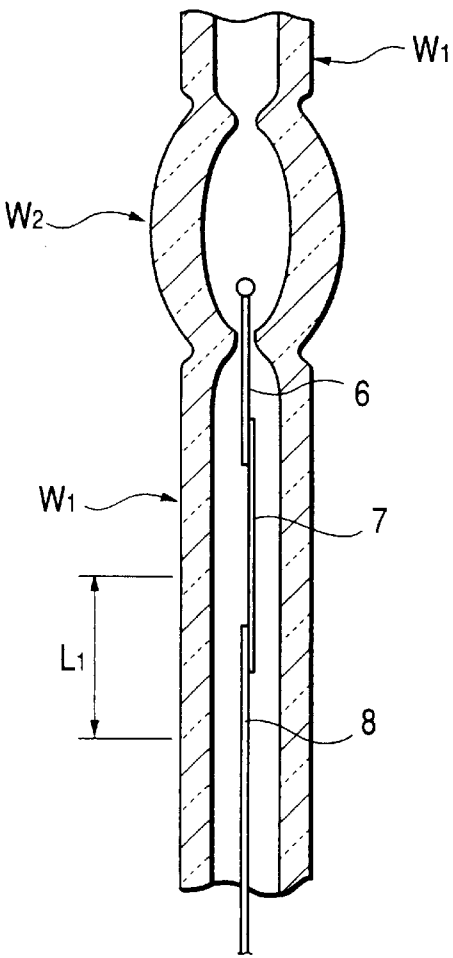
FIG. 3(*a*) is an enlarged cross sectional view showing the primary pinch seal portion before a pinch-sealing operation.
Figure 3B:
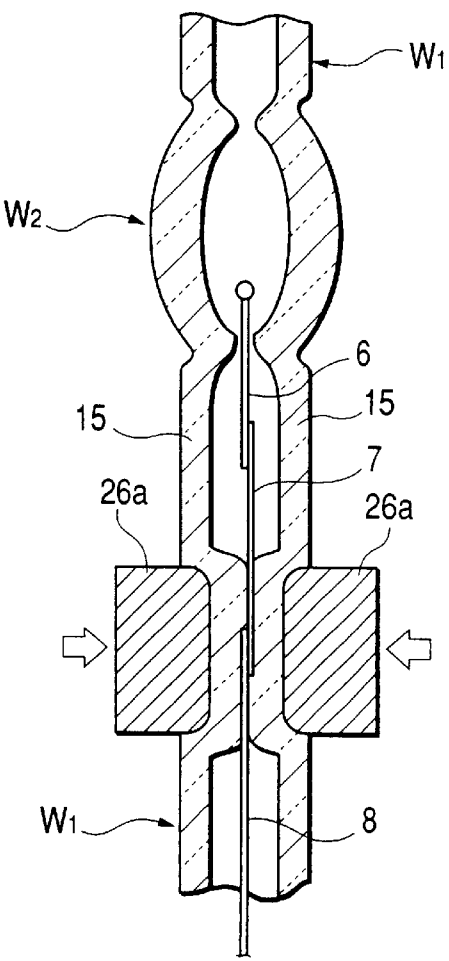
Figure 3C:
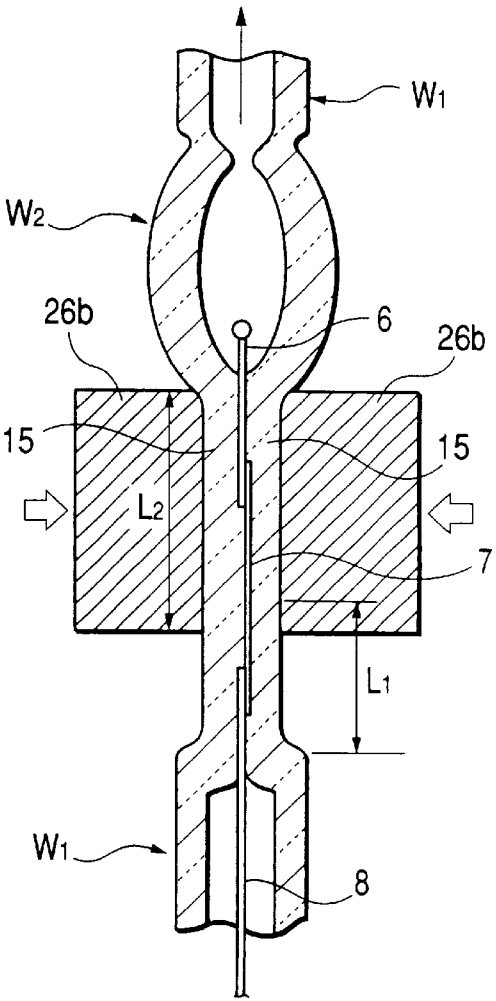
Figures 4A, 4B, 4C, 4D, 4E:
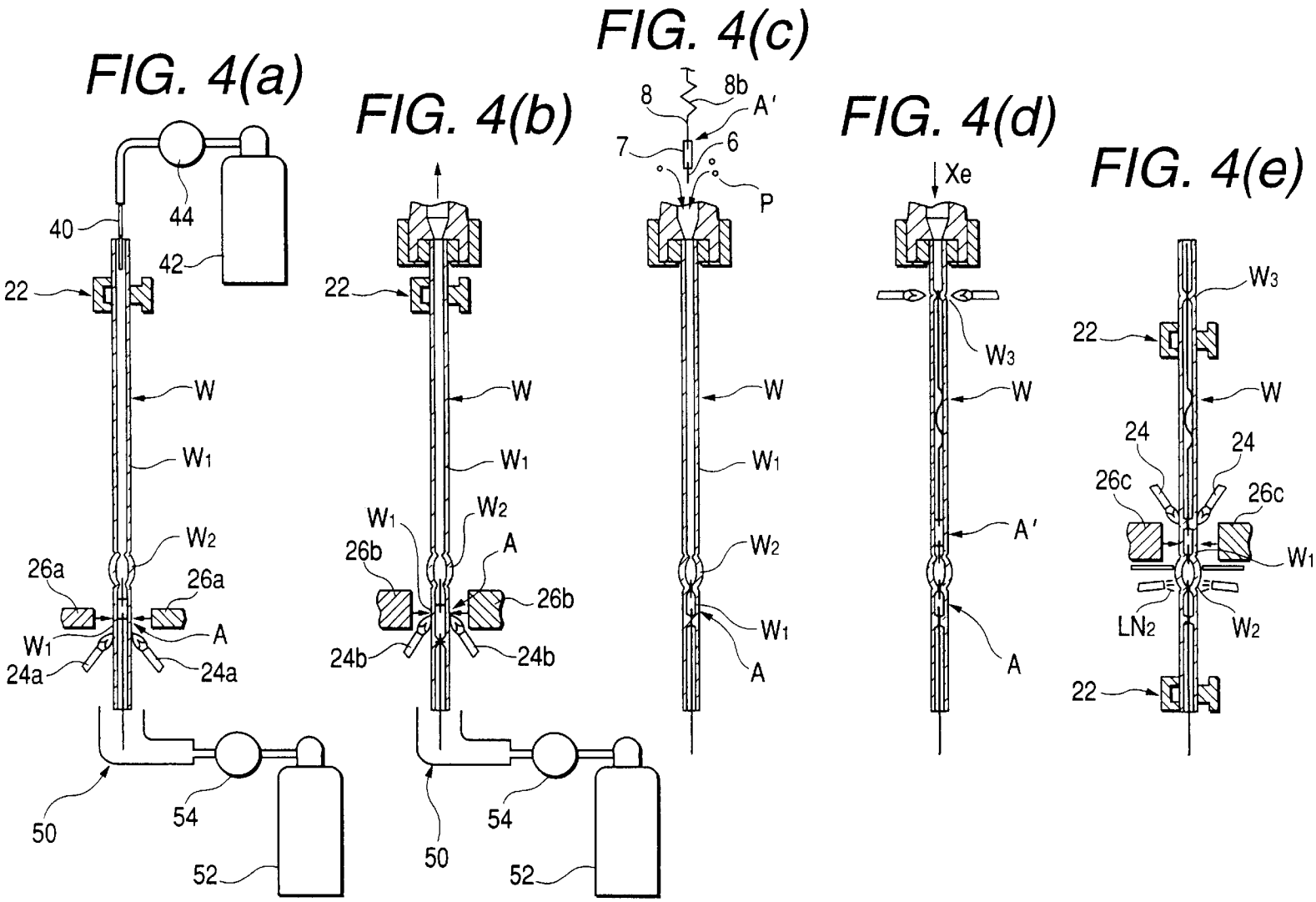
FIG. 4(*a*) is a diagram showing a temporary pinch-sealing step in the primary pinch-sealing step.

FIGS. 1 to 4 show an embodiment of the present invention. FIG. 1 is a vertical cross sectional view showing an arc tube for a discharge lamp unit according to an embodiment of the present invention. FIG. 2 is an enlarged cross sectional view showing a primary pinch seal portion. FIG. 3(*a*) is an enlarged cross sectional view showing the primary pinch seal portion in a state before the pinch seal is performed. FIG. 3(*b*) is an enlarged cross sectional view showing the primary pinch seal portion which has temporarily be pinch-sealed. FIG. 4(*a*) is a diagram showing a temporary pinch-sealing step in the primary pinch seal step. FIG. 4(*c*) is a diagram showing a step for introducing a light emitting substance and the second electrode assembly. FIG. 4(*d*) is a diagram showing a chip-off step. FIG. 4(*e*) is a diagram showing a secondary pinch seal step.

Figure 5:
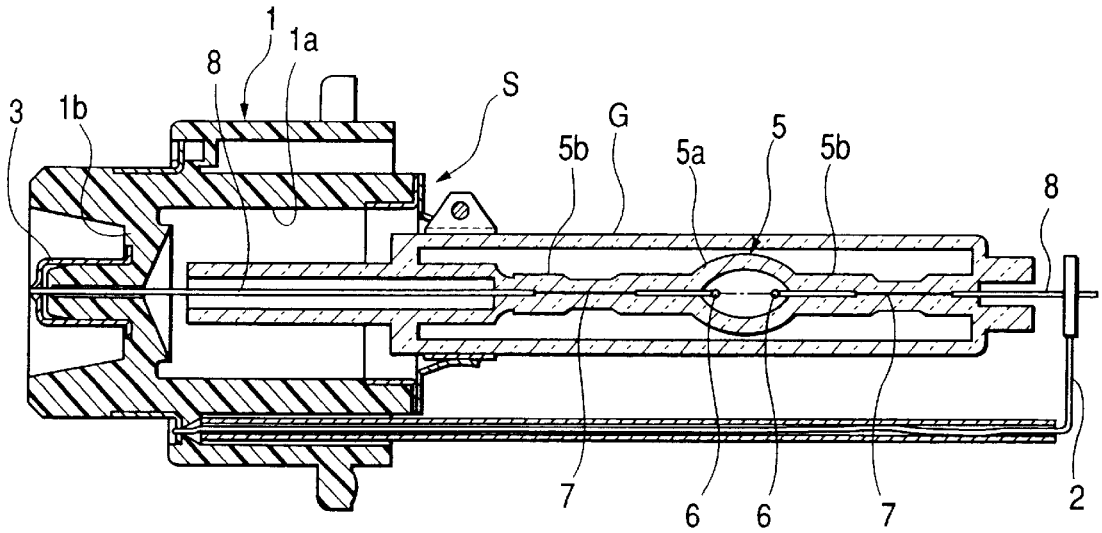
FIG. 5 is a cross sectional view showing a conventional discharge lamp unit.
Figures 6A, 6B, 6C:
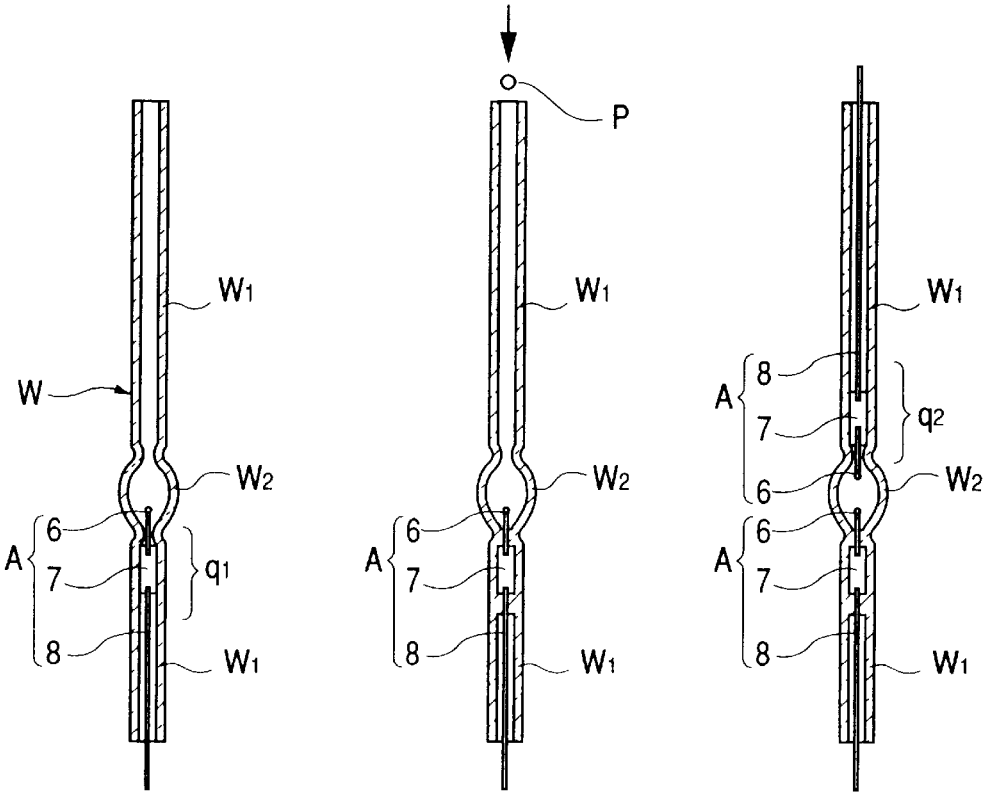
FIG. 6 is a diagram showing a process for manufacturing the conventional arc tube.

Referring to the drawings, the discharge lamp unit on which an arc tube 10 is mounted has the same structure as the conventional structure shown in FIG. 5. Therefore, the description of the discharge lamp unit is omitted.

Referring to FIGS. 1 and 2, the arc tube 10 comprises a quartz glass tube W having a spherical expanded portion $w_2$ formed at an intermediate position of a straight extending portion $w_1$ in a lengthwise direction. Portions adjacent to the spherical expanded portion $w_2$ of the quartz glass tube W are pinch-sealed. Thus, pinch seal portions 13A, 13B, each having a rectangular cross sectional shape, are at the two ends of a chipless sealed chamber portion 12 constituting an elliptically-shaped discharge space. The sealed chamber portion 12 encloses a starting rare gas, mercury and a metal halide (hereinafter called "light emitting substances").

In the sealed chamber portion 12, tungsten electrode rods 6 constituting discharge electrodes are disposed opposite to each other. The electrode rods 6 connect to molybdenum foil 7 sealed in the pinch seal portions 13A, 13B. Molybdenum lead wires 8 connected to the molybdenum foil 7 extend from ends of the pinch seal portions 13A, 13B. The rear lead wire 8 penetrates a circular-pipe-shape portion 14 that is not pinch-sealed to extend to the outside.

The shape of the arc tube 10 shown in FIG. 1 is not considerably changed from the conventional arc tube 5 shown in FIG. 5. Note that the glass layer 15 of each of the pinch seal portions 13A, 13B hermetically contacts the molybdenum foil 7 and the electrode rod 6 of each electrode assembly.

That is, the primary pinch seal portion 13A has a structure includes an electrode assembly A formed by integrally connecting, in series, an electrode rod 6, molybdenum foil 7 and a lead wire 8. The electrode assembly is inserted into an end opening of the quartz glass tube W. The quartz glass tube W has spherical expanded portion $W_2$ formed at an intermediate position in the lengthwise direction of the quartz glass tube W. The leading end of the electrode rod 6 projects into the spherical expanded portion $W_2$ for a predetermined length. Then, a region including the molybdenum foil 7 of the glass tube W is primarily pinch-sealed.

Referring to FIGS. 3(*a*) and 3(*b*), to mold the primary pinch seal portion 13A, a region having a predetermined length $L_1$ and including a portion of the molybdenum foil 7 which is connected to the lead wire 8 is temporarily pinch-sealed. Then, a vacuum (pressure not higher than 400 Torr) in the glass tube W is maintained. Referring to FIG. 3(*c*), the residual region in the region to be primarily pinch-sealed and having a predetermined length $L_2$ is pinch-sealed. Thus, the primary pinch seal portion 13A is molded.

After the temporary pinch-sealing operation has been completed by operating a pincher 26*a*, the pincher 26*b* pinch-seals the remaining portions. At this time, negative pressure from the vacuum in the glass tube W acts on the glass layer 15. The glass layer 15 is softened due to applied heat as well as the pressure exerted by the pincher 26*b*. Therefore, the pinches 26*b* presses the glass layer 15 against the surface of the molybdenum foil 7 to realize a hermetic contact state without any gap. Therefore, satisfactory conformability is realized in the portion which has been pinch-sealed and which has the length $L_2$. As result, the molybdenum foil 7 and glass layer 15 can firmly be joined to each other.

The conventional technique has a problem in that thermal stress produced between the glass layer 15 and the molybdenum foil 7 in the pinch seal portion owing to lighting of the arc tube results in a gap being formed between the glass layer and the molybdenum foil in the primary pinch seal portion 13A,13B. Thus, the sealed light emitting substances in the chamber leak into the gap. Thus, required lighting characteristics cannot be obtained.

Referring to FIG. 2, the length of the region which is pinch-sealed by the pincher 26*b* and has the length $L_2$ is not shorter than 50% of the overall length L of the primary pinch seal portion 13A. Thus, the glass layer 15 is firmly joined to the region that is not shorter than half of the overall length of the molybdenum foil 7.

The main pinch seal region $L_2$ realized by the pincher 26*b* overlaps (length of overlap $\Delta L$ shown in FIG. 2) the temporary pinch seal region which has a length $L_1$ in the axial direction. Therefore, the overall length of region L is reliably pinch-sealed.

An assumption is made that the overall length of the primary pinch seal portion 13A is 14 mm and the overall length of the molybdenum foil 7 is 8.5 mm. In this case, it is preferable that a region having at least a length of about 4 mm of molybdenum foil 7 is pinch-sealed. When the length $L_1$ is shorter than 3 mm, the temporary pinch-sealing operation is insufficient. Sufficient vacuum cannot be produced in the glass tube during the main pinch-sealing operation.

When the length $L_1$ is 8 mm or longer, the main pinch seal region 13A is correspondingly shortened. As a result, adhesion between the glass layer 15 and the molybdenum foil 7 is insufficient, and the portion including the electrode rod 6 cannot completely be sealed.

When the length $L_2$ is 7 mm or shorter, the adhesion between the glass layer 15 and the molybdenum foil 7 is insufficient, and a non-sealed portion is formed. When the length $L_2$ is 12 mm or longer, the large pinch seal range inhibits complete sealing of the portion including the electrode rod 6.

Referring to FIG. 4, a process for manufacturing the arc tube incorporating the chipless sealed chamber portion 12 shown in FIG. 1 will now be described.

The glass tube W having a spherical expanded portion $w_2$ formed at an intermediate position of a straight extending portion $w_1$ is manufactured. Referring to FIG. 4(*a*), glass-tube holding member 22 positions the glass tube W vertically. Then, the electrode assembly A is inserted into an end of the downward opening of the glass tube W so as to be supported at a predetermined position. Then, an forming gas (argon gas or nitrogen gas) supply nozzle 40 is inserted into the end of the upper opening of the glass tube W. Then, the lower end of the glass tube W is inserted into an inactive gas (argon gas or nitrogen gas) supply pipe 50.

The forming gas supplied through the nozzle 40 maintains a pre-load state of the inside portion of the glass tube W to be pinched-sealed and prevents oxidation of the electrode assembly A during the pinch-sealing process. The forming gas supplied through the gas supply pipe 50 maintains an inactive gas atmosphere around the lead wire 8 to prevent oxidation of the lead wire 8 during and after the high-temperature the pinch-sealing process. Referring to FIG. 4(*a*), gas cylinders 42, 52 supply the inactive gas. Gas pressure regulators 44,54 regulate the inactive gas flow.

Referring to FIG. 4(*a*), while supplying forming gas into the glass tube W through both the nozzle 40 and the pipe 50, burner 24*a* heats the position (the position including the molybdenum foil) adjacent to the spherical expanded portion $w_2$ in the straight extending portion $w_1$ to 2100° C. Moreover, the pincher 26*a* pinch-seals a first portion of the molybdenum foil 7 that is connected to the lead wire 8.

Referring to FIG. 4(*b*), after completion of the first portion pinch-sealing process, a vacuum pump (not shown) maintains a vacuum (a pressure level not higher than 400 Torr) in the glass tube W. Then, a burner 24*b* raises the temperature to 2100° C. The pincher 26*b* pinch-seals the portion including the molybdenum foil 7. Preferably, the vacuum exerted on the inside portion of the glass tube W is 400 Torr to $4\times10^{-3}$ Torr.

Thus, within the primary pinch seal portion 13, the glass layer 15 hermetically contacts the electrode rod 6, the molybdenum foil 7 and the lead wire 8 constituting the electrode assembly A. In particular, the glass layer 15 hermetically contacts the electrode rod 6 and the molybdenum foil 7 such that satisfactory conformability is realized and the glass layer 15 and the molybdenum foil 7 (including electrode rod 6) are firmly joined to each other.

In addition, in the primary pinch-sealing process, the atmosphere of the lower opening of the glass tube W is made to be the inactive gas (argon gas or nitrogen gas). This prevents the oxidation of the lead wire 8.

As shown in FIG. 4(*c*), the light emitting substances P are introduced into the spherical expanded portion $w_2$ through an end of the upward opening of the glass tube W. Then, a second electrode assembly A', comprising an electrode rod 6, molybdenum foil 7 and lead wire 8, is inserted to a predetermined position.

The lead wire 8 has a bent portion 8*b* formed at an intermediate position in the lengthwise direction, wherein the bent portion 8*b* is formed into a W-shape. The bent portion 8*b* presses against an inner surface of the glass tube W so that the electrode assembly A' remains at a predetermined position in the lengthwise direction of the straight extending portion $w_1$.

Referring to FIG. 4(*d*), the inside portion of the glass tube W is exhausted, and then a predetermined upper portion of the glass tube W is chipped off while supplying xenon gas into the glass tube W. Thus, the electrode assembly A' having the lead wire is temporarily joined to the inside portion of the glass tube W. Moreover, the light emitting substances are enclosed. Note that symbol $w_3$ represents a chip-off portion.

Referring to FIG. 4(*e*), cooling the sperical expanded portion $w_2$ with liquid nitrogen ($LN_2$) prevents vaporization of the light emitting substances P. Burner 24 heats the position (the position including the molybdenum foil) adjacent to the sperical expanded portion $w_2$ of the straight extending portion $w_1$ to 2100° C. Then, the pincher 26*c* performs a secondary pinch-sealing operation to seal the spherical expanded portion $w_2$. Thus, the arc tube incorporates the chipless sealed chamber portion 12 wherein the electrode rods 6 are disposed opposite to each other and the light emitting substances P are enclosed.

The secondary pinch-sealing process does not require that the inside portion of the glass tube W to be at a negative pressure (by operating the vacuum pump) as distinct from the primary pinch-sealing process. In this case, xenon gas enclosed in the glass tube W is liquefied so that the inside portion of the glass tube W is made to be negative pressure (about 400 Torr). Therefore, the adhesion of the glass layer to the electrode assembly A' (the electrode rod 6, the molybdenum foil 7 and the lead wire 8) in the secondary pinch seal portion 13B improves.

Similarly to the primary pinch-sealing process, the negative pressure acts on the glass layer softened due to supplied heat as well as the pressure exerted by the pincher 26*c*. Therefore, the glass layer is hermetically contacts the electrode rod 6, the molybdenum foil 7 and the lead wire 8 without any gap and with satisfactory conformability. Consequently, the glass layer and the electrode rod 6, the molybdenum foil 7 and the lead wire 8 are firmly joined to each other.

Finally, the end of the glass tube is cut to a predetermined length so that the arc tube 10 shown in FIG. 1 is obtained.

As compared with the mean life of the conventional arc tube that is 1000 hours, the thus-manufactured arc tube 10 exhibits a mean life of 2000 hours.

As described above, the method of manufacturing the arc tube for a discharge lamp unit according to the present invention is able to increase the bonding strength between the glass layer and the molybdenum foil in the primary pinch seal portion. Moreover, the enclosure of the sealed light emitting substances in the sealed chamber portion can be maintained. Therefore, the life of the arc tube can be elongated.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated.

What is claimed is:

1. A method of manufacturing an arc tube for a discharge lamp unit, comprising:

mounting an electrode assembly in an open end of a glass tube, the glass tube including a chamber, and the electrode assembly comprising an electrode rod, a foil and a lead wire integrally connected in series, said mounting step further comprising:

inserting the electrode assembly into the open end of the glass tube such that a leading end of the electrode rod projects into the chamber;

pinch-sealing a temporary pinch seal region of the glass tube such that a portion of the foil is contacted by the glass tube; and creating a vacuum inside the glass tube and pinch-sealing a main pinch seal region of the glass tube such that another portion of the foil and a portion of the electrode rod are contacted by the glass tube;

wherein the length of the main pinch seal region is greater than or equal to 50% of the overall length of the temporary pinch seal region, and a portion of the main pinch seal region only partially overlaps the temporary pinch seal region.

2. A method of manufacturing an arc tube for a discharge lamp unit according to claim 1, wherein the primary pinch seal portion is the overall pinch seal portion created by the combination of the main and temporary pinch seals wherein the length of the main pinch seal region is not less than half of the overall length of the primary pinch seal portion.

3. A method of manufacturing an arc tube for a discharge lamp unit according to claim 1, wherein the vacuum inside the glass tube when pinch-sealing the main pinch seal region is less than or equal to 400 Torr.

4. A method of manufacturing an arc tube for a discharge lamp unit according to claim 1, further comprising filling the glass tube with a forming gas prior to pinch-sealing the temporary pinch seal region of the glass tube.

5. A method of manufacturing an arc tube for a discharge lamp unit according to claim 4, wherein the forming gas in said filling step is argon gas.

6. A method of manufacturing an arc tube for a discharge lamp unit according to claim 4, wherein the forming gas in said filling step is nitrogen gas.

7. A method of manufacturing an arc tube for a discharge lamp unit according to claim 1, further comprising heating the glass tube to at least 2100° C. prior to pinch-sealing the first and main pinch seal regions.

8. A method of manufacturing an arc tube for a discharge lamp unit according to claim 1, further comprising:

after pinch-sealing the main pinch seal region, supplying a light emitting substance to the chamber through an open end of a glass tube; and another mounting of an electrode assembly in an open end of a glass tube, the electrode assembly comprising an electrode rod, a foil and a lead wire integrally connected in series, said mounting step further comprising:

inserting the electrode assembly into the open end of the glass tube such that a leading end of the electrode rod projects into the chamber;

supplying an inactive gas to the inner portion of the glass tube;

pinch-sealing a portion of the glass tube such that a portion of the lead wire is contacted by the glass tube;

cooling the inactive gas in order to liquefy the inactive gas, thereby producing a vacuum in the glass tube;

pinch-sealing another portion of the glass tube such that a portion of the electrode rod, a portion of the foil and a portion of the lead wire are contacted by the glass tube.

9. A method of manufacturing an arc tube for a discharge lamp unit according to claim 8, wherein the inserting step further comprises introducing light emitting substances, the light emitting substances comprising a starting rare gas, mercury and a metal halide.

10. A method of manufacturing an arc tube for a discharge lamp unit according to claim 8, further comprising heating the glass tube to at least 2100° C. prior to pinch-sealing any portion of the glass tube.

11. A method of manufacturing an arc tube for a discharge lamp unit according to claim 8, wherein, in the supplying step, the inactive gas is xenon gas.

12. A method of manufacturing an arc tube for a discharge lamp unit according to claim 8, wherein, in the cooling step, the inactive gas is cooled using liquid nitrogen.

13. A method of manufacturing an arc tube for a discharge lamp unit according to claim 8, wherein, in the cooling step, the inactive gas is cooled under a temperature where the inactive gas enclosed in the glass tube is liquefied.

14. A method of manufacturing an arc tube for a discharge lamp unit, comprising:

mounting an electrode assembly in an open end of a glass tube, the glass tube including a chamber, and the electrode assembly comprising an electrode rod, a foil and a lead wire integrally connected in series, said mounting step further comprising:

inserting the electrode assembly into the open end of the glass tube such that a leading end of the electrode rod projects into the chamber;

pinch-sealing a temporary pinch seal region of the glass tube such that a portion of the foil is contacted by the glass tube; and creating a vacuum inside the glass tube and pinch-sealing a main pinch seal region of the glass tube such that another portion of the foil and a portion of the electrode rod are contacted by the glass tube;

a primary pinch seal portion is the overall pinch seal created by the combination of the main and temporary pinch seals wherein the length of the main pinch seal region is less than, but not less than half, of the overall length of the primary pinch seal portion.

* * * * *